US008835368B2

(12) United States Patent
Kocsis et al.

(10) Patent No.: US 8,835,368 B2
(45) Date of Patent: Sep. 16, 2014

(54) COMPOUNDS AND A METHOD OF LUBRICATING AN INTERNAL COMBUSTION ENGINE

(75) Inventors: Jody A. Kocsis, Chagrin Falls, OH (US); Matthew D. Gieselman, Wickliffe, OH (US); Seth L. Crawley, Mentor, OH (US); Douglas M. Barr, Hudson, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 594 days.

(21) Appl. No.: 13/201,970

(22) PCT Filed: Feb. 8, 2010

(86) PCT No.: PCT/US2010/023462

§ 371 (c)(1),
(2), (4) Date: Nov. 30, 2011

(87) PCT Pub. No.: WO2010/096291

PCT Pub. Date: Aug. 26, 2010

(65) Prior Publication Data

US 2012/0065110 A1 Mar. 15, 2012

Related U.S. Application Data

(60) Provisional application No. 61/153,409, filed on Feb. 18, 2009.

(51) Int. Cl.

| | |
|---|---|
| ***C10M 133/16*** | (2006.01) |
| ***C10M 133/24*** | (2006.01) |
| ***C10M 133/06*** | (2006.01) |

(52) U.S. Cl.

CPC ..... *C10M 133/06* (2013.01); *C10M 2219/046* (2013.01); *C10M 2207/262* (2013.01); *C10M 2223/045* (2013.01); *C10M 2207/028* (2013.01); *C10M 2227/066* (2013.01); *C10N 2240/10* (2013.01); *C10N 2230/12* (2013.01); *C10M 133/24* (2013.01); *C10M 2219/068* (2013.01); *C10M 2215/04* (2013.01); *C10N 2230/42* (2013.01); *C10M 2223/049* (2013.01); *C10N 2230/43* (2013.01); *C10M 133/16* (2013.01); *C10N 2230/45* (2013.01); *C10M 2207/26* (2013.01); *C10M 2207/281* (2013.01); *C10M 2215/12* (2013.01); *C10M 2207/24* (2013.01); *C10M 2207/283* (2013.01)

USPC ..... 508/528; 508/391; 508/518; 508/287

(58) Field of Classification Search

USPC ..... 508/528, 287, 391, 518

See application file for complete search history.

(56) References Cited

U.S. PATENT DOCUMENTS

| | | | | |
|---|---|---|---|---|
| 3,156,652 | A * | 11/1964 | Foehr | 252/75 |
| 3,896,050 | A | 7/1975 | White | |
| 3,903,005 | A * | 9/1975 | Kablaoui et al. | 252/77 |
| 3,966,623 | A | 6/1976 | Krug et al. | |
| 4,012,408 | A | 3/1977 | White | |
| 5,597,390 | A * | 1/1997 | Loper | 44/391 |
| 5,599,779 | A | 2/1997 | Karol et al. | |
| 2004/0038835 | A1 | 2/2004 | Chasan et al. | |

FOREIGN PATENT DOCUMENTS

| | | |
|---|---|---|
| EP | 1642954 | 4/2006 |
| WO | 93/25641 | 12/1993 |

OTHER PUBLICATIONS

Corresponding PCT Publication and Search Report. No. WO 2010/096291 published Aug. 26, 2010.

Written Opinion of corresponding International Application No. PCT/US2010/023462 mailed Apr. 13, 2010.

* cited by examiner

*Primary Examiner* — James Goloboy

(74) *Attorney, Agent, or Firm* — Michael F. Esposito, Esq.; David M. Shold, Esq.

(57) ABSTRACT

The invention provides a lubricating composition containing an oil of lubricating viscosity and a product obtainable from a 1,4-conjugate addition of an aminocarboxylic acid to an activated olefin. The invention further relates to a method of lubricating an internal combustion engine by lubricating the engine with the lubricating composition. The invention further relates to the use of the product disclosed herein as a lead corrosion inhibitor.

19 Claims, No Drawings

COMPOUNDS AND A METHOD OF LUBRICATING AN INTERNAL COMBUSTION ENGINE

FIELD OF INVENTION

The invention provides a lubricating composition containing an oil of lubricating viscosity and a product obtainable from a 1,4-conjugate addition of an aminocarboxylic acid to an activated olefin. The invention further relates to a method of lubricating an internal combustion engine by lubricating the engine with the lubricating composition. The invention further relates to the use of the product disclosed herein as a lead corrosion inhibitor.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives including zinc dialkyldithiophosphates can have harmful effects on bearing corrosion or friction performance. As friction increases, fuel economy tends to decrease. A common antiwear additive for engine lubricating oils is zinc dialkyldithiophosphate (ZDDP). The addition of known friction modifiers (such as glycerol monooleate), are believed to lower the coefficient of friction. However, friction modifiers may have deleterious effects as well such as competing with the antiwear agent or bearing corrosion (typically containing lead and copper).

Various attempts have been made to reduce corrosion caused by ashless additives. These attempts include those disclosed in US Patent Application US 2004/038835; U.S. Pat. Nos. 3,966,623, 3,896,050, U.S. Pat. No. 4,012,408; and European publication EP 1 642 954.

US Patent Application US 2004/038835 discloses certain 1,2,4-triazole metal deactivators are especially non-aggressive towards lead engine parts such as bearings. The inclusion of certain 1,2,4-triazole compounds allows the co-use of corrosive additives such as sulfur-containing additives and vegetable oil-derived friction modifiers.

U.S. Pat. No. 3,966,623 discloses improved copper corrosion properties by employing a lubricant that contains a combination of an alkenyl or alkyl primary amine derivative salt of 2-mercaptobenzothiazole, and 2,5-bis-hydrocarbyldithio-1,3,4-thiadiazole. This combination is suitable for reduction of copper corrosion caused by additives with detergent, dispersancy, load carrying and lubricity functions. These additives may be corrosive in themselves and/or break down during use into corrosive substances which result in severe corrosive attack.

EP 1 642 954 discloses a fluid composition comprising at least one hydroxy-substituted carboxylic acid. The hydroxy-substituted carboxylic acid provides at least one property chosen from rust inhibition, corrosion inhibition, improved lubricity, and improved lead compatibility.

SUMMARY OF THE INVENTION

The inventors of this invention have discovered that a lubricating composition and method as disclosed herein may be capable of providing acceptable levels of at least one of (i) lead corrosion inhibiting performance, (ii) wear and/or extreme pressure performance (typically reducing or preventing), and (iii) friction control (resulting in increased in fuel economy).

In one embodiment the invention provides a lubricating composition comprising an oil of lubricating viscosity and a product obtained/obtainable from a 1,4-conjugate addition of an aminocarboxylic acid to an activated olefin.

In one embodiment the product obtained/obtainable from a 1,4-conjugate addition of an aminocarboxylic acid to an activated olefin may be present at 0.01 wt % to 10 wt %, or 0.05 to 5 wt %, 0.075 to 2, or 0.075 to 0.3 wt % of the lubricating composition.

In one embodiment the invention provides a method for lubricating an engine comprising supplying to the engine a lubricating composition comprising an oil of lubricating viscosity and a product obtained/obtainable from a 1,4-conjugate addition of an aminocarboxylic acid to an activated olefin.

In one embodiment the invention provides for the use of a product obtained/obtainable from a 1,4-conjugate addition of an aminocarboxylic acid to an activated olefin as a lead corrosion inhibitor.

In one embodiment the invention provides for the use of a product obtained/obtainable from a 1,4-conjugate addition of an aminocarboxylic acid to an activated olefin as a lead corrosion inhibitor in an internal combustion lubricant.

In one embodiment the lubricating composition may be further characterised as having at least one of (i) a sulphur content of 0.8 wt % or less, (ii) a phosphorus content of 0.2 wt % or less, or (iii) a sulphated ash content of 2 wt % or less.

In one embodiment the lubricating composition may be further characterised as having (i) a sulphur content of 0.5 wt % or less, (ii) a phosphorus content of 0.1 wt % or less, and (iii) a sulphated ash content of 1.5 wt % or less.

Other components may also be present in the lubricating composition. In one embodiment the lubricating composition further includes at least one of an antiwear agent (such as zinc dialkyldithiophosphate), a friction modifier, a viscosity modifier, an antioxidant, an overbased detergent, a succinimide dispersant, or mixtures thereof. In one embodiment the lubricating composition further includes a viscosity modifier and an overbased detergent. In one embodiment the lubricating composition further includes an overbased detergent and a succinimide dispersant. In one embodiment the lubricating composition further includes an antiwear agent (such as zinc dialkyldithiophosphate).

In one embodiment the invention provides a method for lubricating a mechanical device (typically, an engine) comprising supplying to the device a lubricating composition as disclosed herein.

DETAILED DESCRIPTION OF THE INVENTION

The present invention provides a lubricating composition and a method for lubricating a mechanical device, typically an internal combustion engine as disclosed above.

Aminocarboxylic Acid

The aminocarboxylic acid may be a linear or cyclic compound. In one embodiment the aminocarboxylic acid may be a linear amino carboxylic acid.

The aminocarboxylic acid may be naturally derived or synthetic. In one embodiment the aminocarboxylic acid may be an $\alpha$-amino carboxylic acid, or mixtures thereof.

In one embodiment the aminocarboxylic acid may be a naturally derived amino acid, or mixtures thereof. The aminocarboxylic acid may be enantiomers having configurations of D or L. The enantiomers may also result in a racemic mixture of D and L.

In one embodiment the aminocarboxylic acid may be an amino acid selected from the group consisting of sarcosine, alanine, cysteine, aspartic acid, glutamic acid, phenylalanine, glycine, histidine, isoeucine, lysine, leucine, methionine, asparagine, pyrrolysine, proline, glutamine, arginine, serine, threonine, selenocysteine, valine, tryptophan, tyrosine, disulphides of cysteine, diselenides of selenocysteine, lanthionine or methyllanthionine residues, homocysteine, isoprenylated cysteine, selenocysteine, serine, or threonine, biotinylated lysine, phosphorylated serine, threonine or tyrosine, acetylglucosamine or acetylgalactosamine derivatives of serine or threonine, or N-acetylated or N-alkylated derivatives of the above, or mixtures thereof.

In one embodiment the aminocarboxylic acid may be an amino acid selected from the group consisting of sarcosine, alanine, aspartic acid, glutamic acid, phenylalanine, glycine, histidine, isoleucine, lysine, leucine, asparagine, pyrrolysine, proline, glutamine, arginine, serine, threonine, valine, tryptophan, tyrosine, or mixtures thereof.

In one embodiment the aminocarboxylic acid may be an amino acid selected from the group consisting of sarcosine, alanine, aspartic acid, glutamic acid, glycine, isoleucine, lysine, leucine, asparagine, glutamine, arginine, serine, threonine, valine, tryptophan, tyrosine, or mixtures thereof.

When the product disclosed herein may be employed in an internal combustion engine it may be desirable to use as a reactant an aminocarboxylic acid derived only from carbon, hydrogen, oxygen and nitrogen atoms because it reduces the presence of sulphur or other elements that may detrimentally interact with after treatment devices such as catalytic converters or particulate filters.

Activated Olefin

The activated olefin may be a (meth)acrylate, a (meth) acrylamide, a maleate, an alpha-beta unsaturated nitro compound, an alpha-beta unsaturated nitroso compound, an alpha-beta unsaturated cyano compound, or mixtures thereof.

The activated olefin may include maleates, alpha-beta unsaturated nitro compounds, alpha-beta unsaturated nitroso compounds, or alpha-beta unsaturated cyano compounds.

Alpha-beta unsaturated nitro and alpha-beta unsaturated nitroso compounds are known to a person skilled in the art as forming in situ or made and isolated from synthetic precursors immediately prior to use.

Examples of a suitable cyano compound may include maleonitrile, itaconononitrile, 2-methylene malononitrile, acrylonitrile, ethyl 3-cyanoacrylate, methyl 2-cyanoacrylate, methylacrylonitrile, fumaronitrile, 2-ethyl-2-butenenitrile, butenenitrile, 2-pentenenitrile, ethenetetracarbonitrile, ceylanyle (also known as cinnamyl nitrile), or 4-methoxycinnamonitrile.

Examples of a suitable maleate include di-methyl maleate, di-butyl maleate, di-(2-methylpentyl) maleate, di-2-propylheptyl maleate, di-(2-butyloctyl)maleate, di-(2-ethylhexyl) maleate, di-octyl maleate, di-nonyl maleate, di-isooctyl maleate, di-isononyl maleate, di-(tert-butylheptyl)maleate, di-(3-isopropylheptyl)maleate, di-decyl maleate, di-undecyl maleate, di-(5-methylundecyl)maleate, di-dodecyl maleate, di-(2-methyldodecyl) maleate, di-tridecyl maleate, di-(5-methyltridecyl)maleate, di-tetradecyl maleate, di-pentadecyl maleate, di-hexadecyl maleate, di-(2-methylhexadecyl) maleate, di-heptadecyl maleate, di-(5-isopropylheptadecyl) maleate, di-(5-ethyloctadecyl)maleate, di-(3-isopropyloctadecyl)maleate, di-octadecyl maleate, di-nonadecyl maleate, di-eicosyl maleate, di-2-cetyleicosyl maleate, di-2-stearyleicosyl maleate, di-docosyl maleate, di-2-eicosyltetratriacontyl maleate, or maleates derived from unsaturated alcohols, such as dioleyl maleate, di-cycloalkyl maleate, such as di-(3-vinyl-2-butylcyclohexyl) maleate, or di-bornyl maleate.

As used herein the term "(meth)acrylate" includes both acrylate and methacrylate, the term "(meth)acrylamide" includes both methacrylamide and acrylamide, and the term "(meth)acrylonitrile" includes both methacrylonitrile and acrylonitrile. As used herein the term "alk(en)yl group" includes both alkyl and alkenyl.

The (meth)acrylate or (meth)acrylamide may have substitutent alk(en)yl groups with 1 to 30, or 6 to 20 carbon atoms.

Examples of a suitable (meth)acrylate include a $C_{1-30}$, or $C_{6-20}$ alkyl(meth)acrylate, or mixtures thereof. In one embodiment the (meth)acrylate may be a methacrylate. In one embodiment the (meth)acrylate may be an acrylate.

Examples of the (meth)acrylate include methyl(meth) acrylate, butyl(meth)acrylate, 2-methylpentyl(meth)acrylate, 2-propylheptyl(meth)acrylate, 2-butyloctyl(meth)acrylate, 2-ethylhexyl(meth)acrylate, octyl(meth)acrylate, nonyl (meth)acrylate, isooctyl(meth)acrylate, isononyl(meth) acrylate, 3-isopropylheptyl(meth)acrylate, decyl(meth) acrylate, undecyl(meth)acrylate, 5-methylundecyl(meth) acrylate, dodecyl(meth)acrylate, 2-methyldodecyl(meth) acrylate, tridecyl(meth)acrylate, 5-methyltridecyl(meth) acrylate, tetradecyl(meth)acrylate, pentadecyl(meth) acrylate, hexadecyl(meth)acrylate, 2-methylhexadecyl (meth)acrylate, heptadecyl(meth)acrylate, 5-isopropylheptadecyl(meth)acrylate, 5-ethyloctadecyl (meth)acrylate, 3-isopropyloctadecyl-(meth)acrylate, octadecyl(meth)acrylate, nonadecyl(meth)acrylate, eicosyl (meth)acrylate, 2-cetyleicosyl(meth)acrylate, 2-stearyleicosyl(meth)acrylate, docosyl(meth)acrylate and/or 2-eicosyltetratriacontyl(meth)acrylate; (meth)acrylates derived from unsaturated alcohols, such as oleyl(meth)acrylate; and cycloalkyl(meth)acrylates, such as 3-vinyl-2-butylcyclohexyl(meth)acrylate or bornyl(meth)acrylate.

In one embodiment the (meth)acrylate includes 2-methylpentyl(meth)acrylate, 2-propylheptyl(meth)acrylate, 2-butyloctyl(meth)acrylate, 2-ethylhexyl(meth)acrylate, octyl (meth)acrylate, nonyl(meth)acrylate, isooctyl(meth)acrylate, isononyl(meth)acrylate, 2-tert-butylheptyl(meth)acrylate, 3-isopropylheptyl(meth)acrylate, decyl(meth)acrylate, undecyl(meth)acrylate, 5-methylundecyl(meth)acrylate, dodecyl (meth)acrylate, 2-methyldodecyl(meth)acrylate, tridecyl (meth)acrylate, 5-methyltridecyl(meth)acrylate, or mixtures thereof.

In one embodiment the activated olefin may be a (meth) acrylamide.

Examples of the (meth)acrylamide include methyl methacrylamide, butyl methacrylamide, 2-methylpentyl(meth) acrylamide, 2-propylheptyl(meth)acrylamide, 2-butyloctyl (meth)acrylamide, 2-ethylhexyl(meth)acrylamide, octyl (meth)acrylamide, nonyl(meth)acrylamide, isooctyl(meth) acrylamide, isononyl(meth)acrylamide, 3-isopropylheptyl (meth)acrylamide, decyl(meth)acrylamide, undecyl(meth) acrylamide, 5-methylundecyl(meth)acrylamide, dodecyl (meth)acrylamide, 2-methyldodecyl(meth)acrylamide, tridecyl(meth)acrylamide, 5-methyltridecyl(meth)acrylamide, tetradecyl(meth)acrylamide, pentadecyl(meth)acrylamide, hexadecyl(meth)acrylamide, 2-methylhexadecyl (meth)acrylamide, heptadecyl(meth)acrylamide, 5-isopropylheptadecyl(meth)acrylamide, 5-ethyloctadecyl (meth)acrylamide, 3-isopropyloctadecyl-(meth)acrylamide, octadecyl(meth)acrylamide, nonadecyl(meth)acrylamide, eicosyl(meth)acrylamide, 2-cetyleicosyl(meth)acrylamide, 2-stearyleicosyl(meth)acrylamide, docosyl(meth)acrylamide and/or 2-eicosyltetratriacontyl(meth)acrylamide; (meth)acrylamides derived from unsaturated alcohols, such as oleyl(meth)acrylamide; and cycloalkyl(meth)acrylamides, such as 3-vinyl-2-butylcyclohexyl(meth)acrylamide or bornyl(meth)acrylamide.

In one embodiment the (meth)acrylamide includes 2-methylpentyl, 2-propylheptyl, 2-butyloctyl, 2-ethylhexyl(meth)acrylamide, octyl(meth)acrylamide, nonyl(meth)acrylamide, isooctyl(meth)acrylamide, isononyl(meth)acrylamide, 2-tert-butylheptyl(meth)acrylamide, 3-isopropylheptyl(meth)acrylamide, decyl(meth)acrylamide, undecyl(meth)acrylamide, 5-methylundecyl(meth)acrylamide, dodecyl(meth)acrylamide, 2-methyldodecyl(meth)acrylamide, tridecyl(meth)acrylamide, 5-methyltridecyl(meth)acrylamide, or mixtures thereof.

The product obtained/obtainable from a 1,4-conjugate addition of an aminocarboxylic acid to an activated olefin may be obtained by a process comprising a Michael-type addition reaction. This reaction may be described as a 1,4-conjugate addition of an aminocarboxylic acid to an ethylenically unsaturated material such as an olefin or a (meth)acrylate.

In one embodiment the 1,4-conjugate addition of the aminocarboxylic acid may be to an activated olefin, or mixtures thereof. In one embodiment the 1,4-conjugate addition of the aminocarboxylic acid may be to an acrylate, or mixtures thereof. In one embodiment the 1,4-conjugate addition of the aminocarboxylic acid may be to an methacrylate, or mixtures thereof. In one embodiment the 1,4-conjugate addition of the aminocarboxylic acid may be to a mixture of (i) an acrylate and (ii) a methacrylate.

The 1,4-conjugate addition product of the present invention may also be referred to as a Michael-type addition reaction product. The general reaction involving the Michael-type addition of an amine with a (meth)acrylate is a known reaction. A more detailed discussion of the Michael addition is disclosed in March, Jerry, Advanced Organic Chemistry, 3rd ed. Wiley & Sons, 1985. p. 689. The 1,4-conjugate addition reaction may be carried out at a temperature from −10° C. to 120° C., or 0° C. to 100° C. In the case of a (meth)acrylate, a generic structure of the product formed may be represented by:

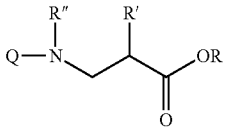

wherein Q-N(R") is the residue of the aminocarboxylic acid, Q and R" are groups bonded to the nitrogen of the amino acid, wherein Q may be a group (or residue) that contains the carboxy group of the original aminocarboxylic acid, R' is methyl or hydrogen and R is an alkyl group.

In the case of the (meth)acrylamide, a generic structure of the product formed may be represented by:

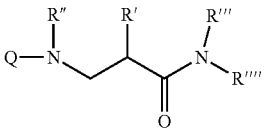

wherein Q, R", and R' are described above. R'" and R"" are substituent groups on the nitrogen of the amide, and may be hydrogen or alkyl.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056]. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Catagories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of the additives in the lubricating composition to the oil of lubricating viscosity and/or to diluent oil include the ranges of 1:99 to 99:1 by weight, or 80:20 to 10:90 by weight.

Other Performance Additives

The composition optionally includes other performance additives. The other performance additives comprise at least one of metal deactivators, viscosity modifiers, detergents, friction modifiers, antiwear agents (other than the compounds of the present invention), corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition of the invention further includes at least one of a friction modifier, a viscosity modifier, an antioxidant, an overbased detergent, a succinimide dispersant, or mixtures thereof.

In one embodiment the lubricating composition of the invention further includes at least one of a viscosity modifier, an antioxidant, an overbased detergent, a succinimide dispersant, or mixtures thereof.

In one embodiment the lubricating composition comprising the β-amino carbonyl compound further includes a phosphorus-containing antiwear agent.

Detergents

In one embodiment the lubricating composition further includes one or more known neutral or overbased detergents. Suitable detergent substrates include phenates, sulphur containing phenates, sulphonates, salixarates, salicylates, carboxylates, phosphates, mono- and/or di-thiophosphates, alkylphenols, sulphur coupled alkylphenol compounds, or saligenins. Various overbased detergents and their methods of preparation are described in greater detail in numerous patent publications, including WO2004/096957 and references cited therein. The detergent substrate may be salted with a metal such as calcium, magnesium, potassium, sodium, or mixtures thereof.

In one embodiment the overbased detergent may be selected from the group consisting of phenates, sulphur containing phenates, sulphonates, salixarates, salicylates, and mixtures thereof. Typically the selected overbased detergents include calcium or magnesium phenates, sulphur containing phenates, sulphonates, salixarates, saliginens, salicylates, or mixtures thereof.

In one embodiment the detergent may be a calcium salicylate. In another embodiment the detergent may be a calcium sulphonate. In another embodiment the invention the detergent may be a mixture of a calcium sulphonate and a calcium salicylate.

In one embodiment the detergent may be a calcium phenate. In another embodiment the detergent may be a calcium sulphonate. In another embodiment the invention the detergent may be a mixture of a calcium sulphonate and a calcium phenate.

When the lubricating composition is not lubricating a 2-stroke marine diesel engine, the detergent may be present (on an oil free basis, i.e., an actives basis) at 0 wt % to 10 wt %, or 0.1 wt % to 8 wt %, or 1 wt % to 4 wt % of the lubricating composition. When the lubricating composition is lubricating a 2-stroke marine diesel engine the amount of detergent (on an oil free basis, i.e., an actives basis) may be 0 wt % to 40 wt %, or 2 wt % to 35 wt %, or 5 wt % to 30 wt % of the lubricating composition.

Dispersants

Dispersants are often known as ashless dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with a polyisobutylene substituent having a number average molecular weight in the range 350 to 5000, or 500 to 3000. Succinimide dispersants and their preparation are disclosed, for instance in U.S. Pat. No. 3,172,892 or U.S. Pat. No. 4,234,435. Succinimide dispersants are typically the imide formed from a polyamine, typically a poly(ethyleneamine).

In one embodiment the invention further includes at least one dispersant which may be a polyisobutylene succinimide derived from a polyisobutylene with number average molecular weight in the range 350 to 5000, or 500 to 3000. The polyisobutylene succinimide may be used alone or in combination with other dispersants.

Another class of ashless dispersant includes Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

In one embodiment the invention further includes at least one dispersant derived from polyisobutylene succinic anhydride, an amine and zinc oxide to form a polyisobutylene succinimide complex with zinc. The polyisobutylene succinimide complex with zinc may be used alone or in combination. A dispersant of this type is an ash-producing dispersant.

The total combined amount of dispersant may be present (on an oil free basis i.e., an actives basis) at 0 wt % to 20 wt %, or 0.1 wt % to 15 wt %, or 0.1 wt % to 10 wt %, or 1 wt % to 6 wt % of the lubricating composition.

Antioxidants

Antioxidant compounds are known and include for example, sulphurised olefins, alkylated diphenylamines (typically di-nonyl diphenylamine, octyl diphenylamine, di-octyl diphenylamine), hindered phenols, molybdenum compounds (such as molybdenum dithiocarbamates), or mixtures thereof. Antioxidant compounds may be used alone or in combination.

The total combined amount of antioxidant may be in ranges (on an oil free basis, i.e., an actives basis) of 0 wt % to 20 wt %, or 0.1 wt % to 10 wt %, or 0.5 wt % to 5 wt %, of the lubricating composition.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the lubricating composition further includes a molybdenum compound.

The molybdenum compound may be selected from the group consisting of molybdenum dialkyldithiophosphates, molybdenum dithiocarbamates, amine salts of molybdenum compounds, and mixtures thereof.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 S-515, and S-600 from Adeka and mixtures thereof.

When present, the molybdenum compound may provide 5 ppm to 1000 ppm, or 10 ppm to 750 ppm, or 20 ppm to 300 ppm, or 30 ppm to 250 ppm of molybdenum to the lubricating composition.

Viscosity Modifiers

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl arene conjugated diene copolymers, polyolefins, esters of maleic anhydride-styrene copolymers.

Dispersant Viscosity Modifiers

Dispersant viscosity modifiers (often referred to as DVM), include functionalised polyolefins, for example, ethylene-propylene copolymers that have been functionalized with an acylating agent such as maleic anhydride and an amine, polymethacrylates functionalised with an amine, or esterified styrene-maleic anhydride copolymers reacted with an amine.

Antiwear Agents

In one embodiment the lubricating composition further includes at least one other antiwear agent other than the β-amino carbonyl compound described herein above.

The additional antiwear agent may be either ashless or ash-forming. Typically ashless antiwear agents do not contain metal, whereas ash-forming do contain metal.

The antiwear agent may be present (on an oil free basis, i.e., an actives basis) in ranges including 0 wt % to 15 wt %, or 0 wt % to 10 wt %, or 0.05 wt % to 5 wt %, or 0.1 wt % to 3 wt % of the lubricating composition.

In one embodiment the lubricating composition further includes a phosphorus-containing antiwear agent. Typically the phosphorus-containing antiwear agent may be present in an amount to deliver the ranges of phosphorus described below in the subject matter under the sub-heading "Industrial Application".

Examples of suitable antiwear agents include phosphate esters, sulphurised olefins, sulphur-containing anti-wear additives including metal dihydrocarbyldithiophosphates (such as primary or secondary zinc dialkyldithiophosphates, or molybdenum dialkyldithiophosphates), molybdenum thiocarbamate-containing compounds including thiocarbamate esters, alkylene-coupled thiocarbamates, and bis(S-alkyldithiocarbamyl)disulphides.

A person skilled in the art will appreciate that any zinc dialkyldithiophosphates may be capable of providing antiwear performance. An example of one such dialkyldithiophosphate is disclosed in PCT Application US07/073428 (entitled "Method of Lubricating an Internal Combustion Engine and Improving the Efficiency of the Emissions Control System of the Engine") or in PCT Application US07/073426 (entitled "Lubricating Oil Composition and Method of Improving Efficiency of Emissions Control System"). Both applications claim priority from Jul. 17, 2006.

The dithiocarbamate-containing compounds may be prepared by reacting a dithiocarbamic acid or salt thereof with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form the sulphurised olefin include propylene, butylene, isobutylene, pentene, hexene, heptene, octene, nonene, decene, undecene, dodecene, undecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides (such as soybean oil), oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl)disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

In one embodiment the further includes a friction modifier, or mixtures thereof. Typically the friction modifier may be present (on an oil free basis, i.e., an actives basis) in ranges including 0 wt % to 10 wt %, or 0.05 wt % to 8 wt %, or 0.1 wt % to 4 wt %.

Examples of suitable friction modifiers include long chain fatty acid derivatives of amines, long chain (typically 8 to 40, or 8 to 20 carbon atoms) fatty acid or derivatives of fatty epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines, esters, or epoxides; fatty alkyl tartrates; fatty alkyl tartrimides; and fatty alkyl tartramides. The fatty alkyl tartrates; fatty alkyl tartrimides; and fatty alkyl tartramides may be the same or different to the amide, ester or imide derivative of a hydroxy-carboxylic acid described above.

In one embodiment the friction modifier may be a long chain fatty acid ester (previously described above as an ashless antiwear agent). In another embodiment the long chain fatty acid ester may be a mono-ester and in another embodiment the long chain fatty acid ester may be a (tri)glyceride.

Other Additives

Other performance additives such as corrosion inhibitors include those described in paragraphs 5 to 8 of International Application WO 2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexyl acrylate and optionally vinyl acetate; demulsifiers including trialkyl phosphates, polyethylene glycols, polyethylene oxides, polypropylene oxides and (ethylene oxide-propylene oxide)

polymers; pour point depressants including esters of maleic anhydride-styrene, polymethacrylates, polyacrylates or polyacrylamides may be useful.

Pour point depressants that may be useful in the compositions of the invention include polyalphaolefins, esters of maleic anhydride-styrene, poly(meth)acrylates, polyacrylates or polyacrylamides.

INDUSTRIAL APPLICATION

The lubricant may be used to lubricate a mechanical device, which, in one embodiment, may be an internal combustion engine.

In one embodiment the internal combustion engine may be a diesel fueled engine, a gasoline fueled engine, a natural gas fueled engine or a mixed gasoline/alcohol fueled engine. In one embodiment the internal combustion engine may be a diesel fueled engine and in another embodiment a gasoline fueled engine.

The internal combustion engine may be a 2-stroke or 4-stroke engine. Suitable internal combustion engines include marine diesel engines, aviation piston engines, low-load diesel engines, and automobile and truck engines.

As used herein the components of the internal combustion engine include all of the parts of the engine derived from metal lubricated by an engine lubricant. This includes, for example, cylinder liners, camshafts, and piston heads.

In one embodiment the internal combustion engine contains ferrous components. The ferrous components include metallic iron or steel, or other materials containing iron. Examples of the ferrous components include FeO, $Fe_3O_4$.

In one embodiment the internal combustion engine contains components of an aluminium-alloy. The aluminium-alloy includes aluminium silicates, aluminium oxides, or other ceramic materials. In one embodiment the aluminium-alloy may be an aluminium-silicate surface. The lubricating composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment the sulphated ash content may be 0.05 wt % to 0.9 wt %, or 0.1 wt % to 0.2 wt % or to 0.45 wt %.

In one embodiment the lubricating composition may be an engine oil, wherein the lubricating composition may be characterised as having (i) a sulphur content of 0.5 wt % or less, (ii) a phosphorus content of 0.07 wt % or less, and (iii) a sulphated ash content of 1.5 wt % or less.

In one embodiment the lubricating composition may be suitable for a 2-stroke or a 4-stroke marine diesel internal combustion engine. In one embodiment the marine diesel combustion engine may be a 2-stroke engine.

The following examples provide illustrations of the invention. These examples are non-exhaustive and are not intended to limit the scope of the invention.

EXAMPLES

Preparative Example 1

(Prep1) is the reaction of (L)-lysine and 2-ethylhexyl acrylate. A two-liter four-necked round bottom flask equipped with an overhead stirrer, sub-surface gas inlet tube, addition funnel, thermowell and Friedrichs condenser is charged with 49.9 g of lysine and 453 g of water and 226 g of methanol. The flask is also charged with 63.5 g of triethylamine. The flask contents provide a 1M solution of glycine in solvent. The flask is stirred for 1 hour at 0° C. The flask is then charged dropwise over a period of 4 hours with 116 g of 2-ethylhexyl acrylate. The flask is then heated to 50° C. and held for 2 hours. The resultant product is then decanted into a separation funnel containing water and brine (200 g). Then the product is washed twice with toluene to form aqueous and organic layers. The organic layer is dried with magnesium sulphate. The organic layer is then rotary evaporated resulting in a final product (124 g, yield 75%).

Preparative Example 2

(Prep2) is the reaction of glycine and 2-ethylhexyl acrylate. A two-liter four-necked round bottom flask equipped with an overhead stirrer, sub-surface gas inlet tube, addition funnel, thermowell and Friedrichs condenser is charged with 50 g of glycine, 444 g of water, and 222 g of methanol. The flask is also charged with 135 g of triethylamine. The flask contents provide a 1M solution of glycine in solvent. The flask is stirred for 1 hour at 0° C. The flask is then charged dropwise over a period of 2 hours with 246 g of 2-ethyl acrylate. The flask is then heated to 55° C. and held for 4 hours. The resultant product is then decanted into a separation funnel containing water and brine (300 g). Then the product is washed twice with toluene to form aqueous and organic layers. The organic layer is dried with sodium sulphate. The organic layer is then filtered with a diatomaceous earth filter and rotary evaporated to yield a final product (213 g, 72%).

Preparative Example 3

(Prep3) is the reaction of (DL)-valine and 2-ethylhexyl acrylate. A two-liter four-necked round bottom flask equipped with an overhead stirrer, sub-surface gas inlet tube, addition funnel, thermowell and Friedrichs condenser is charged with 75 g of valine, 425 g of water, and 212 g of methanol. The flask is also charged with 78.1 g of triethylamine. The flask contents provide a 1M solution of valine in solvent. The flask is stirred for 5 hours at 0° C. The flask is then charged dropwise over a period of 2 hours with 141 g of 2-ethylhexyl acrylate. The flask is then heated to 60° C. and held for 24 hours. The resultant product is then decanted into a separation funnel containing water and brine (300 g). Then the product is washed twice with toluene to form aqueous and organic layers. The organic layer is dried with sodium sulphate. The organic layer is filtered through a glass frit before being rotary evaporated resulting in a final product (92 g, yield 43%).

Preparative Example 4

(Prep4) is the reaction of (L)-leucine and 2-ethylhexyl acrylate. A two-liter four-necked round bottom flask equipped with an overhead stirrer, sub-surface gas inlet tube, addition funnel, thermowell and Friedrichs condenser is charged with 75 g of leucine, 381 g of water, and 191 g of methanol. The flask is also charged with 128 g of triethylamine. The flask contents provide a 1M solution of leucine in solvent. The flask is stirred for 1 hour at 0° C. The flask is then charged dropwise over a period of 4.5 hours with 126 g of 2-ethylhexyl acrylate. The flask is then heated to 65° C. and held for 2 hours. The flask is then heated to 80° C. and held for 3 hours. 50 g of methanol is added. The flask is maintained at 80° C. for 7 hours. The flask is maintained at 80° C. for a further 12 hours. The resultant product is then decanted into a separation funnel containing water and brine (200 g). Then the product is washed twice with toluene to form aqueous and organic layers. The organic layer is dried with sodium sulphate. The organic layer is filtered through a glass frit before being rotary evaporated resulting in a final product (62 g, yield 50%).

Preparative Example 5

(Prep5) is the reaction of sarcosine and 2-ethylhexyl acrylate. A two-liter four-necked round bottom flask equipped with an overhead stirrer, sub-surface gas inlet tube, addition funnel, thermowell and Friedrichs condenser is charged with 50 g of sarcosine, 374 g of water, and 187 g of methanol. The flask is also charged with 62.9 g of triethylamine. The flask contents provide a 1M solution of sarcosine in solvent. The flask is stirred for 1 hour at 0° C. The flask is then charged dropwise over a period of 5 hours with 103 g of 2-ethylhexylacrylate. The flask is then heated to 50° C. and held for 8 hours. The flask is then heated to 80° C. and held for 8 hours. 90 g of methanol is added. The resultant product is dried with sodium sulphate before filtering with a diatomaceous earth filter and rotary evaporation to yield a final product (62 g, yield 40%).

Lubricating Compositions

Comparative Lubricant 1 (CL1): is a lubricating composition designed for a fully formulated SAE 5W-30 passenger car. The lubricating composition is prepared containing typical amounts of additives such as succinimide dispersant, overbased detergents, and zinc dialkyldithiophosphate.

Lubricant Examples 1 (LE1) and 2 (LE2): are SAE 5W-30 lubricants similar to CL1, except they contain 0.1 wt % and 0.4 wt % respectively of the product of Prep1.

Lubricant Examples 3 (LE3) and 4 (LE4): are SAE 5W-30 lubricants similar to CL1, except they contain 0.1 wt % and 0.4 wt % respectively of the product of Prep2.

Lubricant Examples 5 (LE5) and 6 (LE6): are SAE 5W-30 lubricants similar to CL1, except they contain 0.1 wt % and 0.4 wt % respectively of the product of Prep3.

Lubricant Examples 7 (LE7) and 8 (LE8): are SAE 5W-30 lubricants similar to CL1, except they contain 0.1 wt % and 0.4 wt % respectively of the product of Prep4.

Lubricant Examples 9 (LE9) and 10 (LE10): are SAE 5W-30 lubricants similar to CL1, except they contain 0.1 wt % and 0.4 wt % respectively of the product of Prep5.

Test 1: Lead Corrosion Test

The lubricants described above (LE1 to LE10 and CL1) are evaluated in lead corrosion test as defined in ASTM Method D6594-06. The amount of lead (Pb) in the oils at the end of test is measured and compared to the amount at the beginning of the test. Lower lead content in the oil indicates decreased lead corrosion. Overall the results obtained for each lubricant are as follows:

| | CL1 | LE1 | LE2 | LE3 | LE4 | LE5 | LE6 | LE7 | LE8 | LE9 | LE10 |
|---|---|---|---|---|---|---|---|---|---|---|---|
| Pb (mg) | 324 | 159 | 199 | 156 | 194 | 208 | 190 | 176 | 142 | 203 | 173 |

Overall the results indicate that the product obtained as is disclosed as the invention provides lead corrosion inhibition.

It is known that some of the materials described above may interact in the final formulation, so that the components of the final formulation may be different from those that are initially added. The products formed thereby, including the products formed upon employing lubricating composition of the present invention in its intended use, may not be susceptible of easy description. Nevertheless, all such modifications and reaction products are included within the scope of the present invention; the present invention encompasses lubricating composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. Multiple groups represented by the same symbol in the formulae described above, may be the same or different.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008/147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and a product obtained/obtainable from a 1,4-conjugate addition of an aminocarboxylic acid to an activated olefin.

2. The lubricating composition of claim 1, wherein the activated olefin is a (meth)acrylate, a (meth)acrylamide, a maleate, an alpha-beta unsaturated nitro compound, an alpha-beta unsaturated nitroso compound, an alpha-beta unsaturated cyano compound, or mixtures thereof.

3. The lubricating composition of claim 1, wherein the activated olefin is a (meth)acrylate.

4. The lubricating composition of claim 2, wherein the (meth)acrylate is a $C_{1-30}$ alkyl(meth)acrylate.

5. The lubricating composition of claim 1, wherein the aminocarboxylic acid is a linear amino carboxylic acid.

6. The lubricating composition of claim 1, wherein the aminocarboxylic acid is an α-amino carboxylic acid.

7. The lubricating composition of claim 1, wherein the aminocarboxylic acid is selected from the group consisting of sarcosine, alanine, cysteine, aspartic acid, glutamic acid, phenylalanine, glycine, histidine, isoleucine, lysine, leucine, methionine, asparagine, pyrrolysine, proline, glutamine, arginine, serine, threonine, selenocysteine, valine, tryptophan, tyrosine, disulphides of cysteine, diselenides of selenocysteine, lanthionine or methyllanthionine residues, homocysteine, isoprenylated cysteine, selenocysteine, serine, or threonine, biotinylated lysine, phosphorylated serine, threonine or tyrosine, acetylglucosamine or acetylgalactosamine derivatives of serine or threonine, or N-acetylated or N-alkylated derivatives of the above, or mixtures thereof.

8. The lubricating composition of claim 1, wherein the aminocarboxylic acid is derived only from carbon, hydrogen, oxygen and nitrogen atoms.

9. The lubricating composition of claim 1, wherein the aminocarboxylic acid is selected from the group consisting of sarcosine, alanine, aspartic acid, glutamic acid, phenylalanine, glycine, histidine, isoleucine, lysine, leucine, asparagine, pyrrolysine, proline, glutamine, arginine, serine, threonine, valine, tryptophan, tyrosine, or mixtures thereof.

10. The lubricating composition of claim 1, wherein the aminocarboxylic acid is selected from the group consisting of sarcosine, alanine, aspartic acid, glutamic acid, glycine, isoleucine, lysine, leucine, asparagine, glutamine, arginine, serine, threonine, valine, tryptophan, tyrosine, or mixtures thereof.

11. The lubricating composition of claim 1, wherein the lubricating composition is further characterised as having at least one of (i) a sulphur content of 0.8 wt % or less, (ii) a phosphorus content of 0.2 wt % or less, or (iii) a sulphated ash content of 2 wt % or less.

12. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

13. The lubricating composition of claim 1 further comprising at least one of a friction modifier, a viscosity modifier, an antioxidant, an overbased detergent, a succinimide dispersant, or mixtures thereof.

14. The lubricating composition of claim 13, wherein the friction modifier is selected from the group consisting of long chain fatty acid derivatives of amines; long chain fatty acid derivatives of fatty epoxides; fatty imidazolines; amine salts of alkylphosphoric acids; fatty alkyl tartrates; fatty alkyl tartrimides; and fatty alkyl tartramides.

15. The lubricating composition of claim 1 further comprising a phosphorus-containing antiwear agent.

16. The lubricating composition of claim 1 further comprising a molybdenum compound.

17. The lubricating composition of claim 16, wherein the molybdenum compound is selected from the group consisting of molybdenum dialkyldithiophosphates, molybdenum dithiocarbamates, amine salts of molybdenum compounds, and mixtures thereof.

18. The lubricating composition of claim 1 further comprising an overbased detergent, wherein the overbased detergent is selected from the group consisting of phenates, sulphur containing phenates, sulphonates, salixarates, salicylates, and mixtures thereof.

19. A method for lubricating an engine comprising supplying to the engine a lubricating composition of claim 1.

* * * * *